US006799548B2

(12) United States Patent
Furuya

(10) Patent No.: US 6,799,548 B2
(45) Date of Patent: Oct. 5, 2004

(54) BEARING CASE FOR ENGINE

(75) Inventor: Akira Furuya, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 259 days.

(21) Appl. No.: 09/864,074

(22) Filed: May 22, 2001

(65) Prior Publication Data

US 2002/0011230 A1 Jan. 31, 2002

(30) Foreign Application Priority Data

May 23, 2000 (JP) ..... 2000-150853

(51) Int. Cl.[7] ..... F02F 7/00
(52) U.S. Cl. ..... 123/195 R
(58) Field of Search ..... 123/195 R

(56) References Cited

U.S. PATENT DOCUMENTS 4,953,525 A * 9/1990 Sakurai et al. ..... 123/195 R
5,868,110 A * 2/1999 Betsch ..... 123/195 R
6,135,081 A * 10/2000 Eidenboeck et al. .... 123/195 R
6,308,679 B1 * 10/2001 Nakamura et al. ..... 123/195 R
6,640,766 B2 * 11/2003 Furuya et al. ..... 123/195 R

* cited by examiner

*Primary Examiner*—Hanry C. Yuen
*Assistant Examiner*—Jason Benton
(74) *Attorney, Agent, or Firm*—Martin A. Farber

(57) ABSTRACT

A main bearing case has a bearing holder for holding a bearing for supporting a crankshaft, and a crankcase mounting section at which it is joined to a crankcase. Spherical rib walls are formed on one face of the main bearing case opposite to the crankcase for connecting the bearing holder and the crankcase mounting section, on the upper side with respect to the axis of the crankshaft. Force radially exerted to the crankshaft is received by these rib walls, increasing the rigidity of the main bearing case, whereby deformation and play thereof are prevented.

10 Claims, 6 Drawing Sheets

BEARING CASE FOR ENGINE

BACKGROUND OF THE INVENTION

The present invention relates to a bearing case for supporting a bearing of a crankshaft in an engine.

General-purpose engines of an overhead valve (OHV) type or an overhead camshaft (OHC) type are widely used as power sources for lawn mowers, power-driven sprayers, generators, and others. The crankshaft of such engines is generally supported by ball bearings (hereinafter referred to simply as "bearing"). In most cases, the crankshaft is supported at both ends thereof by the bearings.

The bearings are held in a crankcase and/or a main bearing case (hereinafter referred to simply as "bearing case") mounted thereto. Generally, the bearing on one side is accommodated in and held by a bearing holder provided in a wall of the crankcase, while the other bearing is accommodated in and held by the bearing case.

FIG. 7 is a cross-sectional view showing a structure of a conventional bearing case. The conventional bearing case 100 includes a bearing holder 102 protruded at the center of a side wall 101 as shown in FIG. 7. Along an outer periphery of the bearing case 100 is formed a crankcase mounting section 103 (hereinafter referred to simply as "mounting section") which is to be joined to a cover mounting surface of the crankcase through a gasket. A hollow 104 is formed between the mounting section 103 and the bearing holder 102. The bearing holder 102 accommodates a ball bearing (not shown) therein and thereby supports one end of the crankshaft.

Apart from a force in an axial direction, the crankshaft is subjected to a force exerted orthogonally thereto in an explosion stroke. The bearing accordingly receives the force exerted thereto in a radial direction orthogonal to the crankshaft in addition to the force in the rotational direction. The bearing case 100 shown in FIG. 7 receives such force in the bearing holder 102.

The bearing case 100, however, has a mounting section 103 overhung from the bearing holder 102, and therefore when subjected to a radially acting force, the bearing holder 102 warps from its base end, resulting in deformation in the side wall 101. The radially exerted force also acts on the mounting section 103 as moment, whereupon a compressive force and a shearing force act between the mounting section 103 and the crankcase. The gasket interposed therebetween is subjected to such forces repeatedly and is accordingly deformed over and over again. Thus deterioration of the gasket proceeds quickly, leading to the risk of oil leakage.

In the high-performance engines with higher speed for higher output in recent years, the bearing holder 102 is subjected to ever increasing load. The bearing case shown in FIG. 7 is hardly capable of withstanding such load, and therefore an improvement in the structure of bearing case has been desired.

SUMMARY OF THE INVENTION

An object of the present invention is to provide a rigid and light bearing case.

In order to achieve the object, there is provided a bearing case for an engine according to the present invention, which is attached to a crankcase of the engine for supporting the bearing of a crankshaft in the engine, and includes a bearing holder for holding the bearing, a crankcase mounting section formed on an outer peripheral surface of the bearing case to be joined to the crankcase, and a rib wall formed in the bearing case on a side of the crankcase and extending between the bearing holder and the crankcase mounting section.

According to the present invention, a force acting on the bearing holder in a radial direction through the crankshaft is received by the rib wall, so that the bearing holder can be prevented from warping at its base end as the conventional bearing case. Also, the crankcase mounting section receives less moment, whereby its movement is restricted. As a result, damage to the gasket caused by deformation or play of the bearing case is prevented, whereby the lifetime and reliability of the product are improved.

The rib wall may be formed in a spherical shape so as to better support the bearing holder by arched wall surface, thereby enhancing the rigidity of the bearing case. The thickness of the rib wall can be reduced accordingly so as to make the bearing case more lightweight. Vibration and operation noise can also be absorbed and restricted more efficiently by the spherical wall, resulting in overall enhancement of the product performance.

The rib wall is preferably formed on an upper side of the bearing case with respect to the axis of the crankshaft. The lower side of the bearing case is less affected by the radially acting force, and so the rib wall therefor is omitted, thereby increasing a degree of freedom of design with respect to the lower side, from the axis of the crankshaft, of the bearing case.

Additionally, a cavity may be formed on the lower side of the bearing case with respect to the axis of the crankshaft, so as to open toward the side of the crankcase and to form part of an oil pan for the engine. Thereby, the rigidity of the bearing case is improved while the oil reservoir capacity is secured.

The bearing case may further include a reinforcing rib formed along the outer periphery thereof on one surface of the crankcase mounting section on the opposite side from the crankcase, for securing rigidity of the bearing case in its surface direction.

Preferably, the crankcase mounting section includes a plurality of bolt holes for passing a plurality of bolts therethrough so as to fixedly couple the bearing case to the crankcase, the reinforcing rib being formed so as to connect these bolt holes. The reinforcing rib is preferably formed to part of the bearing case where the above-mentioned rib wall exists.

BRIEF DESCRIPTION OF THE DRAWINGS

These and other objects and advantages of the present invention will become clearly understood from the following description with reference to the accompanying drawings, wherein.

DETAILED DESCRIPTION OF THE PREFERRED EMBODIMENTS

Preferred embodiments of the present invention will be hereinafter described in detail with reference to the accompanying drawings.

Figure 1:
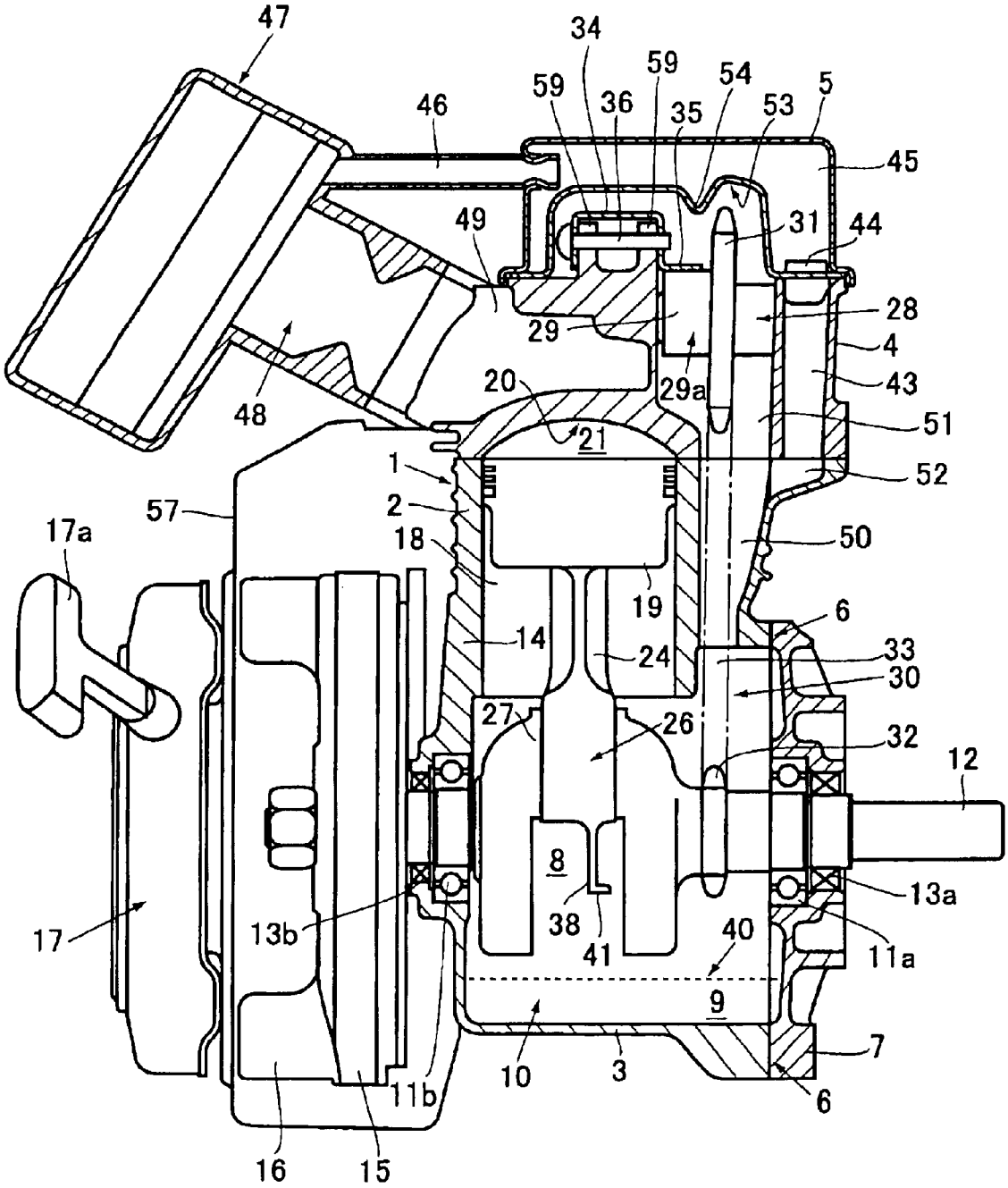
FIG. 1 is a diagram given in explanation of the structure of an OHC engine in which a bearing case according to one embodiment of the present invention is applied.
Figure 2:
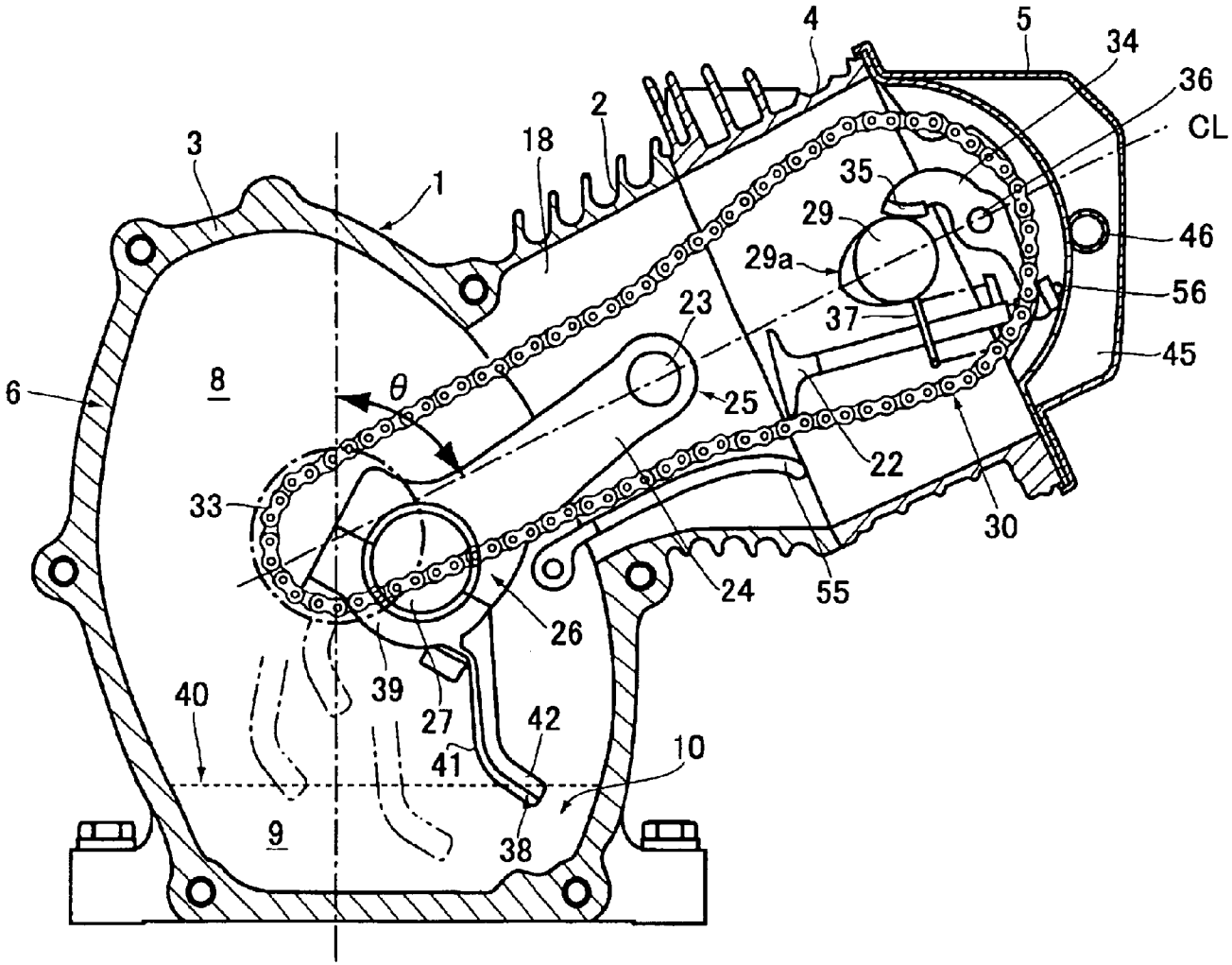
FIG. 2 is an explanatory cross-sectional view along a direction of axis of the cylinder in the engine of FIG. 1.

FIG. 1 is a diagram given in explanation of the structure of an OHC engine in which a bearing case according to one embodiment of the invention is applied. FIG. 2 is an explanatory cross-sectional view taken along a direction of the cylinder axis of the engine of FIG. 1. The engine of FIG. 1 is a single-cylinder 4-cycle gasoline engine, and is a so-called "inclined OHC engine" in which a cylinder axis CL is inclined by an angle θ with respect to the gravitational direction (see FIG. 2). In the engine, an engine body 1 includes a cylinder block 2 and a crank case 3 which are integrally formed with each other. The engine body 1 is made of iron or a light metal alloy such as an aluminum alloy. A cylinder head 4 made of the aluminum alloy is attached to an upper portion of the cylinder block 2. A rocker cover 5 made of a sheet metal or a synthetic resin is mounted on top of the cylinder head 4.

The crank case 3 has a large opening on the right side thereof in FIG. 1, thereby providing a main bearing case attachment surface 6. A main bearing case 7 (hereinafter referred to simply as "bearing case") made of the aluminum alloy is attached to the main bearing case attachment surface 6. Thus, a crank chamber 8 is provided in the crank case 3, and an oil pan 10 is provided under the crank chamber 8 for storing a lubricating oil (hereinafter referred to simply as "oil") 9.

A main bearing 11*a* is press-fitted into the main bearing case 7, and one end of a crankshaft 12 is supported by the main bearing 11*a*. An oil seal 13*a* is press-fitted on the outer side of the main bearing 11*a*.

Figure 3:
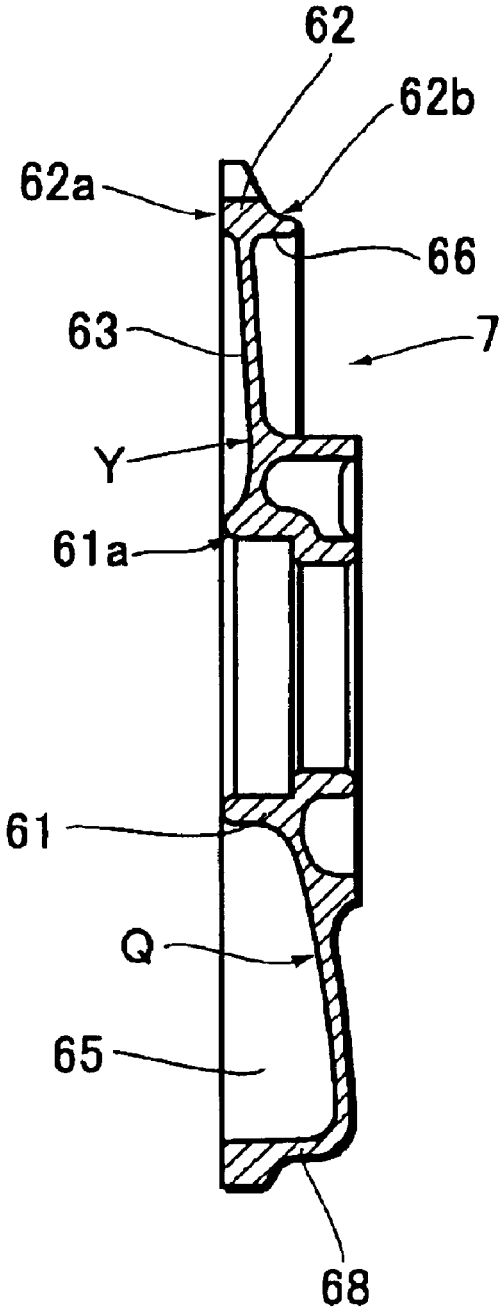
FIG. 3 is a cross-sectional view showing the structure of the bearing case according to the present invention.
Figure 4:
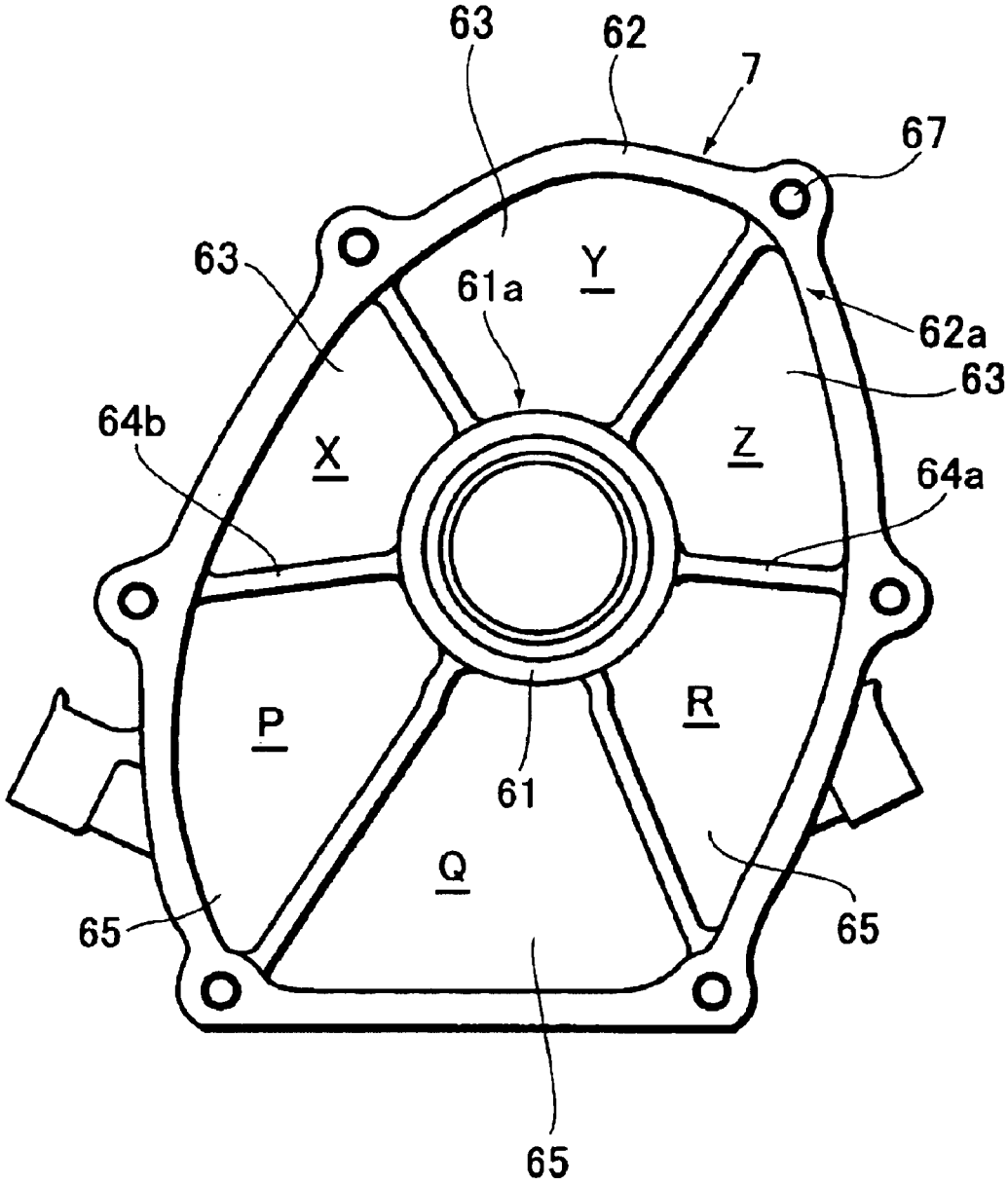
FIG. 4 is a left side view of the bearing case of FIG. 3.
Figure 5:
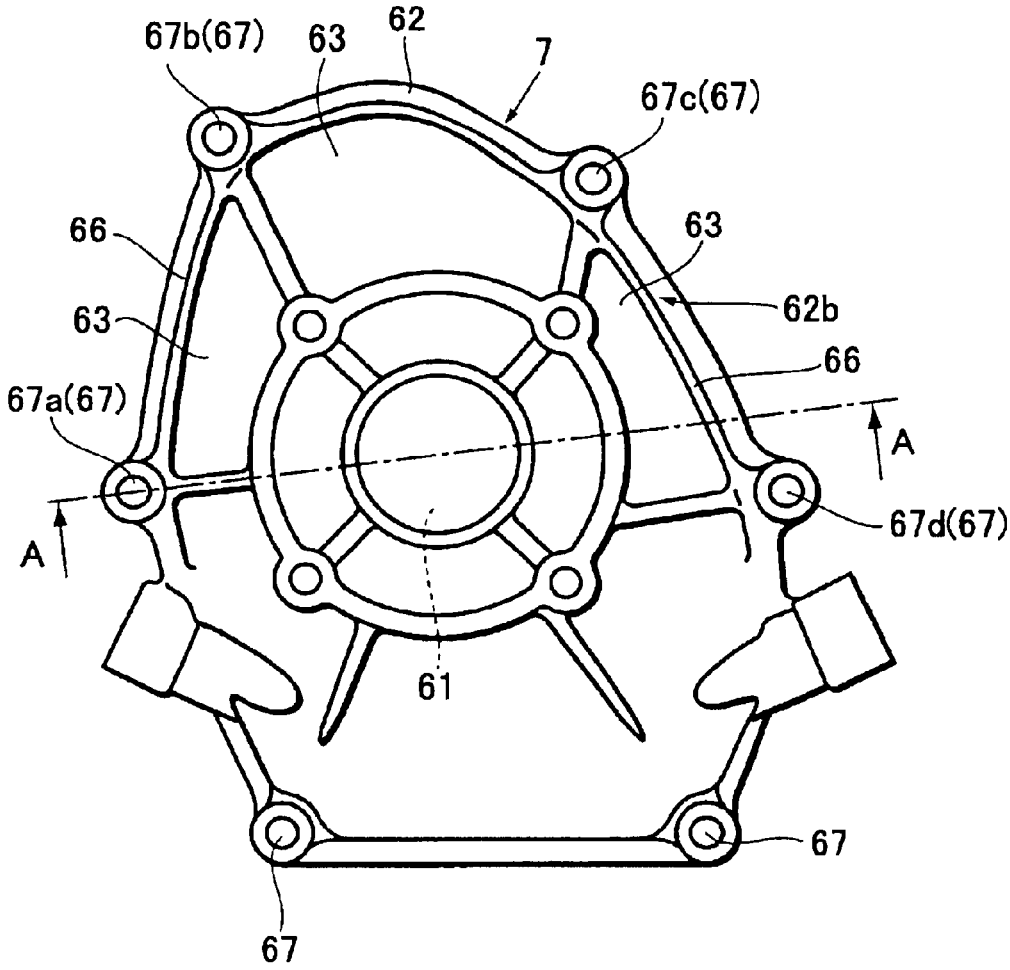
FIG. 5 is a right side view of the bearing case of FIG. 3.
Figure 6:
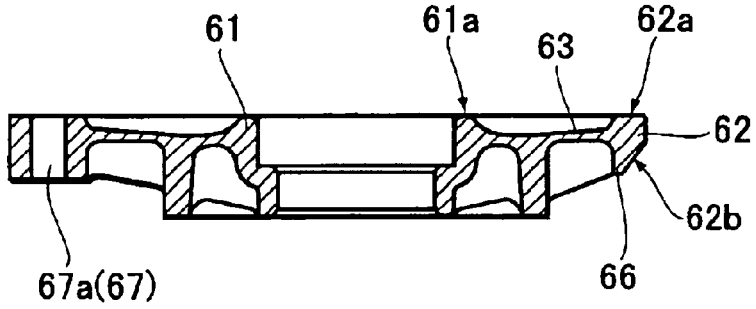
FIG. 6 is a cross-sectional view taken along the line A—A in FIG. 5.

FIG. 3 is a cross-sectional view of the bearing case 7, FIG. 4 being a left side view and FIG. 5 being a right side view of same. FIG. 6 is a cross-sectional view taken along the line A—A in FIG. 5. The bearing case 7 has a bearing holder 61 substantially at its center for holding and accommodating the main bearing 11*a*, as shown in FIGS. 3 through 6. The bearing case 7 also includes a crankcase mounting section 62 (hereinafter referred to simply as "mounting section") formed along its outer periphery, which is to be joined to the main bearing case mounting face 6 of the crankcase 3. The bearing case 7 is coupled to the crankcase 3 by bolts, and therefore the mounting section 62 includes a plurality of bolt holes 67 for passing the bolts therethrough. Although not shown, a gasket is interposed between the main bearing case mounting face 6 and the mounting section 62.

The crankshaft 12 receives an cyclic force at an expansion stroke of a combustion as mentioned above which is exerted in a radial direction. Accordingly, the bearing holder 61 is subjected to such a force through the main bearing 11*a*. The force acts on the upper side of the bearing holder 61 from the center of the crankshaft towards the cylinder, and therefore the upper side of the bearing holder 61 is particularly affected. In view of the above, the bearing case 7 according to the present invention has a spherical wall for connecting the inner side end of the bearing holder 61 and that of the mounting section 62 to receive the load exerted on the upper, inner side of the bearing holder 61.

More specifically, as shown in FIG. 3, the bearing case 7 includes a plurality of rib walls 63 on the upper side with respect to the axis of the crankshaft 12, on the face to which the crankcase 3 is connected. The rib walls 63 extend from the vicinity of the inner side end 61*a* of the bearing holder 61 towards the vicinity of the inner side end 62*a* of the mounting section 62, thereby directly connecting the bearing holder 61 and the mounting section 62. Referring now to FIG. 4, the three faces X, Y, Z defined on the upper side of two radially extending ribs 64*a*, 64*b* construct the rib walls 63.

The rib walls 63 are formed as part of a spherical surface of a large radius having a center concentric with the axis of the crankshaft. In other words, the rib walls 63 are curved, one side face thereof bulging upward from the plane of FIG. 4, respectively.

Therefore, the force which is applied in a radial direction thereof to the bearing holder 61 via the crankshaft 12 as mentioned above is transmitted to the rib walls 63, so that the bearing holder 61 is supported by the rib walls 63. Thus, the bearing holder 61 does not warp or distort at its base end as in the prior art, and the bearing case 7 is accordingly prevented from being deformed. Also, the mounting section 62 receives less moment, resulting in less play thereof. In other words, the overall rigidity of the bearing case 7 is improved, whereby damage to the gasket is prevented, leading to improved lifetime and reliability of the product.

Moreover, the bearing holder 61 of the bearing case 7 is supported on the arched wall surface because of the spherical structure of the rib walls 63, securing high rigidity. In view of this, the rib walls 63 can be made thinner than other portion accordingly, whereby the weight of the bearing case 7 can be reduced. The spherical wall surfaces also absorb and restrict vibration and operating noise efficiently, whereby the overall performance of the product is enhanced.

The other three faces P, Q, and R on the lower side of the ribs 64*a*, 64*b* form cavities 65, respectively, as shown in FIGS. 3 and 4. These cavities 65 open toward the side of the crankcase 3 of the engine, forming a part of the oil pan 10. Since the lower side of the bearing holder 61 is subjected to less load as described above, rib walls 63 should not necessarily be provided also to the lower side of the bearing case 7. In view of this, the lower side of the bearing holder 61 is formed with cavities 65 and not with the rib walls 63 in this preferred embodiment, so as to secure a certain capacity for containing oil 9 and to achieve a reduction in weight of the bearing case 7. Of course, the lower side faces P, Q, and R may also be formed as the rib walls 63 if an enough amount of oil can be held without such cavities 65.

The bearing case 7 of the invention further has a reinforcing rib 66 provided on the upper side of the outer side face 62*b* of the mounting section 62, as shown in FIGS. 3 and 5. The reinforcing rib 66 extends along the periphery of the mounting section 62 so as to connect the four bolt holes 67*a*, 67*b*, 67*c*, and 67*d* provided on the side where the rib walls 63 are formed. Such reinforcing rib 66 may be formed around the entire periphery of the bearing case 7.

Figure 7:
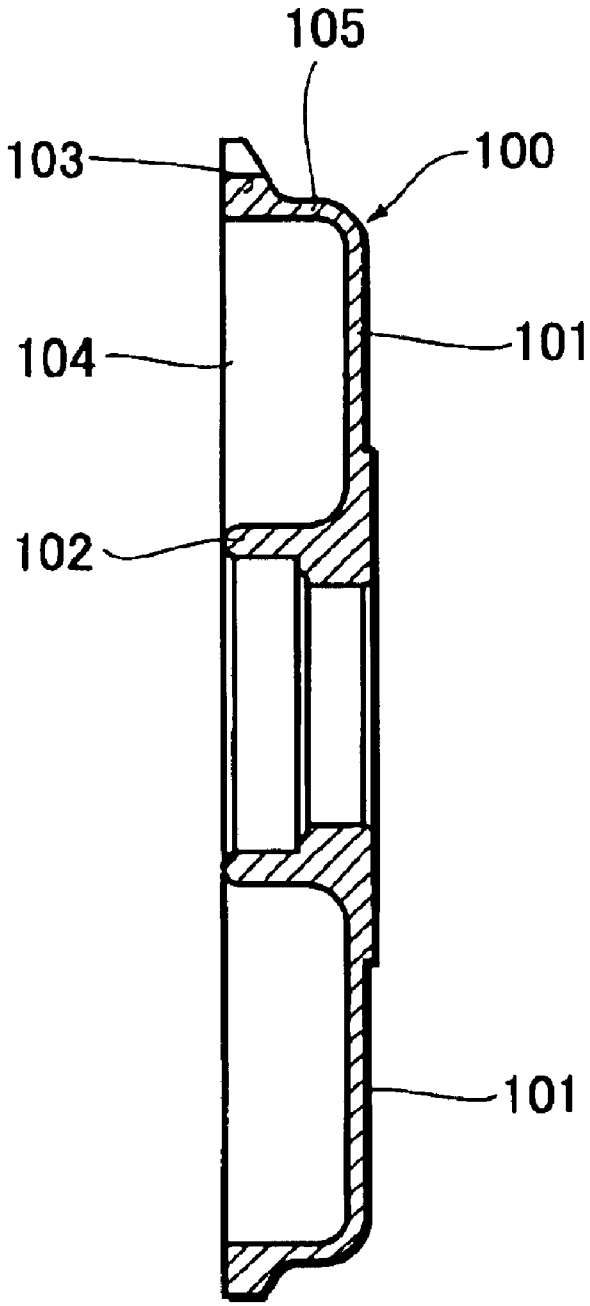
FIG.7 PRIOR ART
FIG. 7 is a cross-sectional view showing the structure of a conventional bearing case.

In the prior art shown in FIG. 7, the rigidity in the surface direction of the bearing case 100 (hereinafter referred to simply as "surface rigidity") was secured by the outer peripheral wall 105 extending along the mounting section 103. In the bearing case 7 of the invention, while the lower part thereof has required surface rigidity secured by the outer peripheral wall 68 forming the cavities 65, the surface rigidity of the upper part of the bearing case is dependent on the thickness of the rib walls 63. Thus the upper part may have a relatively low surface rigidity compared to that of the lower part. Accordingly, the bearing case 7 of the present invention is provided with the reinforcing rib 66 on the outer side face 62*b* of the mounting section 62 so as to secure the surface rigidity in part where the rib walls 63 are formed. In this way, the bearing case 7 of the invention has sufficient rigidity of the case itself, because of withstanding the force exerted orthogonally to the crankshaft 12. A main bearing 11*b* is press-fitted into a wall surface 14 of the crank case 3 opposite to the main bearing case attachment surface 6. The other end side of the crankshaft 12 is supported by the main bearing 11*b*. Similarly, an oil seal 13*b* is provided on the outer side of the main bearing 11*b*. The oil seals 13*a* and 13*b* prevent the oil 9 stored in the oil pan 10 from leaking out of the crank case 3 along the crankshaft 12.

A flywheel 15 and a cooling fan 16 are attached to the other end portion of the crankshaft 12 that extends out of the crank case 3 through the wall surface 14. The cooling fan 16 is provided outside the crank case 3 and within a casing 57, and rotates together with the crankshaft 12 so as to introduce a cooling air from an outside of the casing 57. The engine body 1 and the cylinder head 4 are cooled by the introduced cooling air. Moreover, a recoil device 17 is provided on the outer side of the casing 57. By pulling a recoil lever 17*a* by hand, the crankshaft 12 is rotated to start the engine.

A cylinder bore 18 is provided in the cylinder block 2. A piston 19 is fitted within the cylinder bore 18 so as to be slidable therein. An upper end of the cylinder bore 18 is closed by the cylinder head 4, and an upper surface of the piston 19 and a bottom wall surface 20 of the cylinder head 4 together form a combustion chamber 21. An intake valve 22, an exhaust valve (not shown), an ignition plug (not shown) are provided facing the upper portion of the combustion chamber 21.

A small end portion 25 of a connecting rod 24 is rotatably connected to the piston 19 via a piston pin 23.

A crank pin 27 of the crankshaft 12 is rotatably connected to a large end portion 26 of the connecting rod 24. Thus, the crankshaft 12 is rotated along with the vertical reciprocation of the piston 19.

A camshaft 28 is provided in the cylinder head 4 in parallel with the crankshaft 12 on the cylinder axis CL. The camshaft 28 includes a valve-operating cam 29 and a sprocket 31, which are integrally formed with each other. The valve-operating cam 29 is driven in synchronization with the crankshaft 12 by a timing system 30.

A sprocket 32 is secured on the crankshaft 12. Chain chambers 50 and 51 are provided in the cylinder block 2 and the cylinder head 4, respectively, and the sprocket 31 and the sprocket 32 are connected to each other via a chain 33 provided in the chain chambers 50 and 51. The sprockets 31, 32 and the chain 33 form the timing system 30. The number of teeth of the sprocket 31 is twice as large as the number of teeth of the sprocket 32, so that the valve-operating cam 29 undergoes one revolution per two revolutions of the crankshaft 12. The chain 33 is provided with an appropriate tension by a chain tensioner 55.

The valve-operating cam 29 is provided with a cam surface 29*a*, and a slipper 35 formed at one end of a rocker arm 34 slidably contacts with the cam surface 29*a*. Two rocking type rocker arms 34 are provided respectively for intaking and exhausting air. Each of the rocker arms 34 is provided to rock around a rocker shaft 36 which is supported by a rocker support 59. The other end of each rocker arm 34 is connected to a top end portion of the intake valve 22 or an exhaust valve (not shown) via an adjust screw 56. The intake valve 22 and the exhaust valve are each driven as the rocker arm 34 is rocked by the valve-operating cam 29. The intake valve 22 and the exhaust valve are each biased by a valve spring 37 toward the closed position. Thus, the intake valve 22 is opened/closed along with the rotation of the valve-operating cam 29.

The timing system 30 is lubricated by a scraper 38 provided on a large end portion 26 of the connecting rod 24. As illustrated in FIG. 2, the scraper 38 extends downward from a lower member 39 of the large end portion 26, i.e., in a radial direction of the crankshaft 12. The scraper 38 rocks along with the rotation of the crankshaft 12 through a path as indicated by a one-dotted-chain line in FIG. 2. Thus, the oil 9 stored in the oil pan 10 is scraped up by the scraper 38, and the oil 9 is splashed onto the chain 33 when the scraper 38 comes out of an oil surface 40, thereby lubricating the timing system 30.

The scraper 38, having a generally L-shaped cross section, includes a bottom wall 41 and a side wall 42 extending integrally with the bottom wall 41 along one side of the bottom wall 41. In the present embodiment, the angle between the bottom wall 41 and the side wall 42 is set to be 90°. However, the angle therebetween is not limited to the right angle, but may be appropriately selected in the range of about 60° to about 90°.

Along with the rocking of the scraper 38, the oil 9 is scraped up by the bottom wall 41, and the oil 9 scraped up by the bottom wall 41 is guided to the side wall 42 and splashed away from the side wall 42. Thus, the droplets of the oil 9 are splashed also in three-dimensionally inclined directions, i.e., in the lateral direction from the scraper 38, thereby throwing a little amount of droplets of the oil 9 toward the root end portion of the chain tensioner 55. A little amount of the droplets hit the inner wall of the crank case 3 and are bounced back toward the chain 33. In this way, droplets of the oil 9 can be supplied to the chain 33, which is offset toward the main bearing case 7 with respect to the scraper 38, thereby ensuring the supply of the oil 9 to the chain 33.

The oil 9 thus splashed onto the chain 33 is transferred toward the cylinder head 4 along with the movement of the chain 33, thereby lubricating the sprocket 31 also. Moreover, the sprocket 32 is also lubricated by the oil 9 attached on the chain 33.

On the side of the cylinder head 4, a little amount of the oil 9 attached on the chain 33 is shaken off by a centrifugal force. Specifically, as a portion of the chain 33 travels around the sprocket 31, a little amount of the oil 9 on that portion of the chain 33 is thrown off the chain 33 in the circumferential direction of the sprocket 31. In the illustrated engine, the rocker cover 5 is provided above the sprocket 31, and those droplets of the oil 9 hit the ceiling surface 53 of the rocker cover 5. The oil 9 attached onto the ceiling surface 53 runs down along the ceiling surface 53 back into the oil pan 10 via the chain chambers 51 and 50.

The ceiling 53 of the rocker cover 5 includes a protrusion 54 as shown in FIG. 1, so that oil 9 attached on the ceiling 53 can readily drip therefrom. The protrusion 54 is positioned above the valve operating cam 29 and the slipper 35 where they make sliding contact with each other, so that the sliding parts are lubricated by the dripping oil 9.

In the cylinder head 4, a gas-liquid separation chamber 43 is provided separately from the chain chamber 51. Another gas-liquid separation chamber 45 is provided in the rocker cover 5 and is communicated to the gas-liquid separation chamber 43 via a lead valve 44. The gas-liquid separation chamber 45 is connected to an air cleaner 47 via a blow-by passage 46. The air cleaner 47 is connected to an intake port 49 in the cylinder head 4 via a carburetor 48.

The gas-liquid separation chambers 43, 45 are provided for separating a mist of the oil 9 from a blow-by gas as the blow-by gas stored in the crank chamber 8 is recirculated to the air cleaner 47. In the illustrated engine, the gas-liquid separation chamber 43 is opened to the chain chamber 50, which is provided separately from the cylinder bore 18. Thus, a gas inlet 52 is provided at the upper end portion of the chain chamber 50 of the cylinder block 2, and the blow-by gas, which has flowed into the chain chamber 50, flows into the gas-liquid separation chamber 43 via the gas inlet 52. As the blow-by gas flows through the gas-liquid separation chamber 43, the oil mist contained therein attaches to the wall surface of the gas-liquid separation chamber 43, thereby separating the oil mist from the blow-by gas. The oil component, which has been separated in the gas-liquid separation chamber 43, returns to the oil pan 10 via the wall surfaces of the gas-liquid separation chamber 43 and then to the chain chamber 50.

The blow-by gas, which has flowed into the rocker cover 5 via the lead valve 44, is subjected to a further oil mist separation process in the gas-liquid separation chamber 45. Specifically, the oil mist contained in the blow-by gas, which has entered the gas-liquid separation chamber 45, attaches to the wall surface of the gas-liquid separation chamber 45, thereby achieving a further gas-liquid separation. Moreover, an oil return hole (not shown) may be provided in the bottom surface of the rocker cover 5, whereby the oil 9, which has attached to the wall surface of the gas-liquid separation chamber 45, flows into the chain chambers 51 and 50 through the oil return hole and returns to the oil pan 10 via the wall surface of the chain chambers 51 and 50.

The present invention has been specifically described above with respect to a particular embodiment thereof. It is understood, however, that the present invention is not limited to the above-described embodiment, but rather various modifications can be made thereto without departing from the scope and spirit of the present invention.

For example, the rib walls 63 may be formed in a conical shape or planar shape in parallel to the crankcase mounting face instead of the spherical shape.

While the present invention is applied to an inclined type of engine in the embodiment described above, it is of course possible to apply the present invention to a normal engine in which the cylinder axis is arranged in the gravitational direction. Moreover, while the present invention is applied to an air-cooled engine with a single-cylinder, the present invention may alternatively be applied to an air-cooled engine with a multi-cylinder, or a liquid-cooled engine with a single- or multi-cylinder.

While the cylinder block 2 and the crank case 3 are formed integrally with each other in the embodiment described above, they may alternatively be provided separately, and the cylinder head 4 and the cylinder block 2 may be formed integrally with each other.

In addition, while the timing system 30 is provided by using the sprockets 31 and 32 and the chain 33 in the embodiment described above, the timing system 30 may alternatively be provided by using other driving members known in the art, such as a cogged pulley and a cogged belt, or a timing pulley and a timing belt.

Moreover, in the present invention, the term "rotation" has a general concept including a circular motion in both directions, i.e. a clockwise direction and a counterclockwise direction, not a circular motion in only one direction.

According to the bearing case of the present invention, rib walls are formed between the bearing holder and the crankcase mounting section, so that a force radially exerted to the bearing holder is received by these rib walls, whereby the rigidity of the bearing case is improved. Accordingly, the bearing holder is less likely to deform, and the crankcase mounting section is subjected to less moment, allowing for less play thereof.

As a result, damage to the gasket caused by deformation or play of the bearing case is prevented, whereby the lifetime and reliability of the product are improved.

The rib walls are formed in a spherical shape so as to further enhance the rigidity of the bearing case, while the thickness of the rib walls can be reduced to make the bearing case more lightweight. Vibration and operation noise can also be absorbed and restricted more efficiently, resulting in overall enhancement of the product performance.

Moreover, cavities are formed in the bearing case on the lower side with respect to the axis of the crankshaft so as to form part of the oil pan for the engine, whereby the rigidity of the bearing case is further improved while the oil reservoir capacity is secured.

Furthermore, a reinforcing rib is formed on the outer side face of the crankcase mounting section, so that the rigidity of the crankcase in a surface direction is secured.

In particular, the reinforcing rib is formed to a portion where the rib walls exist, thus contributing to enhancement of the surface rigidity together with the rib walls, thereby improving rigidity of the bearing case.

While there have been described what are at present considered to be preferred embodiments of the present invention, it will be understood that various modifications may be made thereto, and it is intended that the appended claims cover all such modifications as fall within the true spirit and scope of the invention.

What is claimed is:

1. A bearing case attached to a crankcase of an engine for holding a bearing for supporting a crankshaft of said engine, comprising:

a bearing holder for holding said bearing;

a crankcase mounting section formed on an outer peripheral surface of said bearing case to be joined to said crankcase; and a rib wall formed in said bearing case on a side of said crankcase and extending between said bearing holder and said crankcase mounting section.

2. The bearing case according to claim 1, wherein said rib wall is formed in a spherical shape.

3. The bearing case according to claim 1, wherein said rib wall is formed on an upper side of the bearing case with respect to an axis of said crankshaft.

4. The bearing case according to claim 3, wherein a cavity is formed on a lower side of said bearing case with respect to said axis of the crankshaft, the cavity opening toward the side of said crankcase and forming part of an oil pan for said engine.

5. The bearing case according to claim 1, further comprising:

a reinforcing rib formed along the outer periphery of said bearing case on one surface of said crankcase mounting section on the opposite side from said crankcase.

6. The bearing case according to claim 3, further comprising:

a reinforcing rib formed along the outer periphery of said bearing case on one surface of said crankcase mounting section on the opposite side from said crankcase.

7. The bearing case according to claim 5, wherein said crankcase mounting section includes a plurality of bolt holes for passing a plurality of bolts therethrough so as to fixedly couple said bearing case to said crankcase, said reinforcing rib being formed so as to connect said plurality of bolt holes.

8. The bearing case according to claim 6, wherein said crankcase mounting section includes a plurality of bolt holes for passing a plurality of bolts therethrough so as to fixedly couple said bearing case to said crankcase, said reinforcing rib being formed so as to connect said plurality of bolt holes.

9. The bearing case according to claim 5, wherein the reinforcing rib is formed at a part of the bearing case where said rib wall exists.

10. The bearing case according to claim 7, wherein the reinforcing rib is formed at a part of the bearing case where said rib wall exists.

* * * * *